US011136956B2

(12) United States Patent
Gilpatrick et al.

(10) Patent No.: US 11,136,956 B2
(45) Date of Patent: Oct. 5, 2021

(54) BATTERY COMMUNICATION SYSTEM

(71) Applicant: FNA Group, Inc., Pleasant Prairie, WI (US)

(72) Inventors: Richard J. Gilpatrick, Burlington, WI (US); Chris Alexander, Park Ridge, IL (US)

(73) Assignee: FNA Group, Inc., Pleasant Prairie, WI (US)

( * ) Notice: Subject to any disclaimer, the term of this patent is extended or adjusted under 35 U.S.C. 154(b) by 322 days.

(21) Appl. No.: 16/022,995

(22) Filed: Jun. 29, 2018

(65) Prior Publication Data

US 2020/0003172 A1 Jan. 2, 2020

(51) Int. Cl.

| | |
|---|---|
| ***F02N 11/08*** | (2006.01) |
| ***B08B 3/02*** | (2006.01) |
| ***B05B 9/04*** | (2006.01) |
| *F02N 11/14* | (2006.01) |

(52) U.S. Cl.

CPC ..... *F02N 11/0862* (2013.01); *B05B 9/0403* (2013.01); *B08B 3/02* (2013.01); *F02N 11/0803* (2013.01); *B08B 2203/027* (2013.01); *F02N 11/14* (2013.01)

(58) Field of Classification Search

CPC .. F02N 11/0862; F02N 11/0803; F02N 11/14; F02N 2300/306; F02N 11/08; B05B 9/0403; B08B 3/02; B08B 2203/027

See application file for complete search history.

(56) References Cited

U.S. PATENT DOCUMENTS

| | | | | |
|---|---|---|---|---|
| 9,579,990 | B2 * | 2/2017 | Butler | H02J 7/0021 |
| 10,400,732 | B2 | 9/2019 | Harvey et al. | |
| 2009/0269218 | A1 * | 10/2009 | Gardner | F04B 17/06 417/234 |
| 2013/0111864 | A1 * | 5/2013 | Hansen | B60T 7/14 56/10.8 |
| 2013/0111865 | A1 * | 5/2013 | Hansen | A01D 34/828 56/11.3 |
| 2013/0343906 | A1 | 12/2013 | Funke et al. | |
| 2014/0299089 | A1 * | 10/2014 | Koenen | H02J 7/0027 123/179.28 |
| 2016/0108881 | A1 | 4/2016 | Hansen et al. | |
| 2016/0115933 | A1 * | 4/2016 | Koenen | B60T 7/042 290/38 R |
| 2018/0351383 | A1 * | 12/2018 | Zeiler | B60L 58/10 |

* cited by examiner

*Primary Examiner* — Joseph J Dallo

(74) *Attorney, Agent, or Firm* — Steven E. Jedlinski; Jeffrey T. Placker; Holland & Knight LLP

(57) ABSTRACT

According to an implementation, a pressure washer system may include a pump and an engine drivingly coupled with the pump. A pressure washer controller may be associated with one or more of the pump and the engine. A battery may be communicatively coupleable with the pressure washer controller for one or more of receiving data from the pressure washer controller and transmitting data to the pressure washer controller. The battery may include a memory module for storing one or more of data received from the pressure washer controller and data to be transmitted to the pressure washer controller.

11 Claims, 2 Drawing Sheets

BATTERY COMMUNICATION SYSTEM

TECHNICAL FIELD

The present disclosure generally relates to battery operated tools, and more particularly relates to battery operated tools including data communication functionality associated with a battery for conveying data between the battery operated tool and a remote computing device or data network.

BACKGROUND

Many domestic and commercial water usage applications may require relatively high pressures, which may be beyond the capacity of residential and/or municipal water distribution and supply systems. For example, heavy duty cleaning applications may benefit from increased spraying pressure that is greater than the pressure available from common residential and/or municipal water distribution and supply systems. In some situations, various nozzles may be utilized to constrict the flow of the water to provide an increase in the pressure of the resultant water stream. However, many tasks may benefit from even greater pressures than can be achieved with common pressure nozzles that may be attached to a hose. In such circumstances pressure washers may be utilized, in which a power driven pump may be employed to increase the pressure significantly above pressures that are readily achievable using hose attachments. Such elevated pressures may increase the efficiency and/or effectiveness of some cleaning and spraying tasks.

SUMMARY

In an implementation, a pressure washer system may include a pump, an engine drivingly coupled with the pump, and a pressure washer controller associated with one or more of the pump and the engine. The pressure washer system may also include a battery communicatively coupleable with the pressure washer controller for one or more of receiving data from the pressure washer controller and transmitting data to the pressure washer controller. The battery may also include a memory module for storing one or more of data received from the pressure washer controller and data to be transmitted to the pressure washer controller.

One or more of the following features may be included. The battery may include a rechargeable battery that is configured to be removably coupled with the pressure washer system. The battery may be configured for energizing an electric starter associated with the engine. The battery may be communicatively coupleable with the pressure washer controller via a wireless connection between the battery and the pressure washer controller. The battery may be communicatively coupleable with the pressure washer controller via a wired connection between the battery and the pressure washer controller. The battery may include a communication module that may be configured to be communicatively coupled with one or more of a remote computing device and a data network.

The communication module may include a wireless communication module that is configured to be communicatively coupled with a mobile computing device. The communication module may include a wireless communication module that may be configured to be communicatively coupled with a data network. The communication module may include a wired communication module. The pressure washer controller may be configured to receive one or more sensor inputs associated with one or more of the pump and the engine. The battery may be communicatively coupleable with the pressure washer controller for receiving data based upon, at least in part, the one or more sensor inputs. The battery may be communicatively coupleable with the pressure washer controller for transmitting one or more operational parameters for one or more of the pump and the engine to the pressure washer controller. The one or more operational parameters may be received by the battery from a remote computing device.

According to another implementation, a tool system may include a functional tool system. The tool system may also include a tool controller associated with the functional tool system for one or more of receiving sensor data associated with the functional tool system, and controlling one or more operational parameters of the functional tool system. The tool system may also include a battery removably coupleable with the functional tool system for providing operating power for the functional tool system. The battery may be communicatively coupleable with the tool controller for one or more of receiving data from the tool controller and transmitting data to the tool controller. The battery may also be communicatively coupleable with one or more of a remote computing device an a data network. The battery may further include a memory module for storing data.

DETAILED DESCRIPTION OF EXAMPLE EMBODIMENTS

Figure 1:
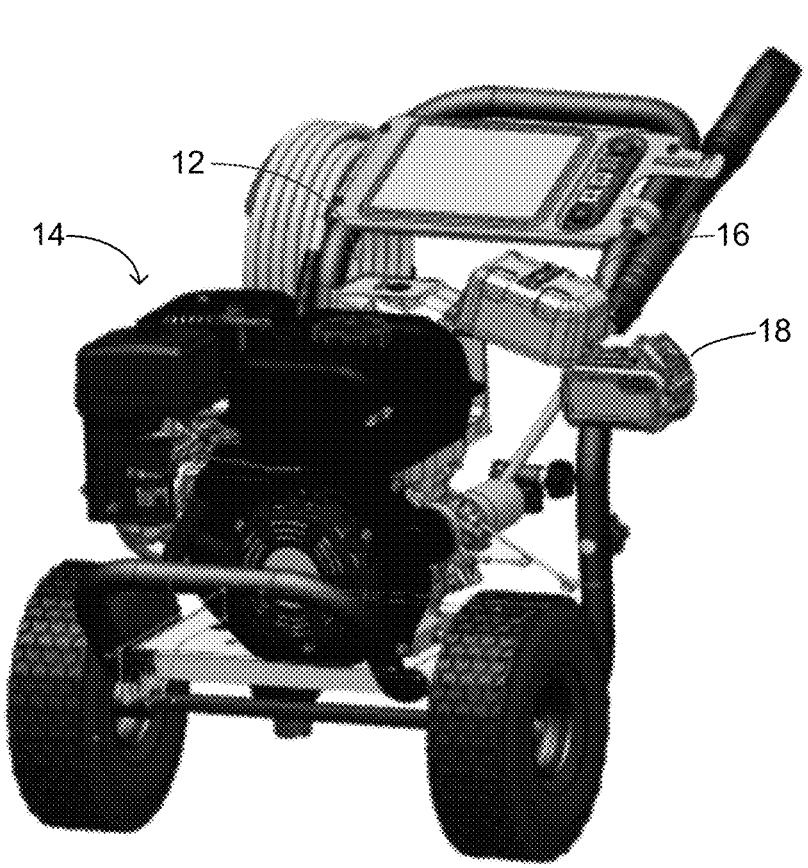
FIG. 1 diagrammatically depicts a pressure washer system consistent with an illustrative embodiment.

In general, the present disclosure may provide a battery powered tool utilizing a removable and/or replaceable battery pack, such as rechargeable battery pack. The battery pack include communication functionality that may allow the battery pack to communicate with a remote computing device and/or a data network. The battery pack may collect tool data from the tool while the battery pack is coupled with the tool. The communication functionality may allow the collected tool to be uploaded to the remote computing device and/or data network (e.g., and thereby to a computing device coupled with the data network). Additionally/alternatively, the communication functionality of the battery pack may allow data to be received from the remote computing device and/or data network (e.g., and thereby to a computing device coupled with the data network). Further, data based upon, at least in part, the received data may be passed to the tool when the battery pack is coupled with the tool. As such, it may be possible for the remote computing device and/or data network to receive data from and/or pass data to the tool via the battery. In this regard, it may not be necessary for the tool to include communication functionality for communicating with a remote computing device and/or data network. In some implementations, eliminating the need for the tool to include communication functionality may reduce the cost and/or complexity of the tool, while still providing the ability for communication between the tool and a remote computing device and/or data network. Additionally, in some embodiments, the battery pack providing the communication functionality may be capable of being coupled with more than one tool. As such, a single battery pack may provide communication functionality for the more than one tool.

Consistent with some embodiments, a battery operated tool may be, at least in part, powered by a replaceable battery pack (also generally referred to herein as a "battery"), such as a rechargeable battery pack. In addition to at least partially powering some aspect of the tool, the battery may include a storage device that may interact with a controller associated with the tool for transmitting data to the controller associated with the tool and/or to receive data from the controller associated with the tool. According to various implementations, the data transmitted to the controller associated with the tool may include, but is not limited to, operating parameters or settings for the tool (e.g., which may control, modify, and/or set some aspect of the operation of the tool). According to various implementations, the data received from the controller associated with the tool may include, but is not limited to, performance data, operating characteristics, and/or usage information associated with one or more aspect of the tool. It will be appreciated that various additional and/or alternative data may be transmitted to and/or received from the controller associated with the tool. As generally used herein, the controller associated with the tool may include any controller, processor, or circuitry that may be capable of transmitting data to and/or receiving data from the storage device of the battery.

In some implementations, the battery may provide communication functionality in addition to receiving data from and/or transmitting data to the controller associated with the tool. For example, communication functionality may allow the battery (e.g., the storage device of the battery) to communicate with a remote computing device and/or a data network. In various implementations, the battery may include a communication module that may provide direct communication between the storage device and a remote computing device and/or data network, and/or may provide communication between the storage device and the remote computing device and/or data network via one or more intermediary devices. By remote computing device, it is meant a computing device that is external to and/or not part of the battery, regardless of geographic proximity between the battery and the computing device. In an embodiment, the battery communication module may provide wireless communication between the battery (i.e., between the storage device of the battery) and a remote computing device and/or data network, such as Bluetooth communication, WiFi communication, or other wireless communication. In an embodiment, the battery communication module may provide wired communication between the battery (i.e., between the storage device of the battery) and a remote computing device and/or data network. It will be appreciated that the battery may include one or more processors, controllers, and/or other hardware, firmware, and/or software that may facilitate communication between the battery storage device and the tool, remote computing device, and/or data network. Additionally, it will be appreciated that the same, and/or different, processors, controllers, and/or other hardware, firmware, and/or software may be utilized to facilitate communication between the battery storage device and the tool and between the battery storage device and the remote computing device and/or data network.

As generally discussed above, implementations consistent with the present disclosure may allow information to be collected from a tool, or settings of the tool to be established and/or changed, without requiring the expense and/or complexity of communication systems being included in the tool. Further, in some embodiments, a single battery may be used to provide communication functionality to more than one tool, either of the same kind, and/or of differing kinds.

The present disclosure may be utilized in connection with any variety of battery powered tools (e.g., which may be at least in part powered by a battery). Examples of such tools may include, but are not limited to saws (e.g., circular saws, reciprocating saws, jig saws, band saws, and the like), drills and drivers (e.g., power drills, impact drills, powered screw drivers, impact drivers, and the like), rotary tools (e.g., grinders, routers, rotary cut-off tools, and the like), oscillating tools, sanders (e.g., orbital sanders, disc sanders, belt sanders, and the like), nailers (e.g., power nailers, power staplers, and the like), as well as various other tools. In a particular embodiment, the power tool may include a pressure washer, or other fluid pumping tool. In some embodiments, the pressure washer may include an engine driven pressure washer, in which the battery may be utilized, at least in part, for starting the engine (e.g., by providing electrical power to an electric starter for the engine). In some embodiments, the pressure washer may include one or more control or monitoring features, in which the battery may be utilized, at least in part, for powering the control or monitoring features of the pressure washer.

In an example embodiment, and referring to FIG. 1, a pressure washer system 10 may generally include a pump 12 and an engine 14 drivingly coupled with the pump 12. The pressure washer system 10 may further include a pressure washer controller 16 associated with one or more of the pump 12 and the engine 14. The pressure washer system 10 may further include a battery 18 communicatively coupleable with the pressure washer controller 16 for one or more of receiving data from the pressure washer controller 16 and transmitting data to the pressure washer controller 16. The battery 18 may further include a memory module (not shown) for storing one or more of data received from the pressure washer controller 16 and data to be transmitted to the pressure washer controller 16.

Consistent with various embodiments, the pump 12 may include any pump for conveying fluid and/or increasing the pressure of the fluid relative to a fluid source or supply. For example, in an embodiment, the pump 12 may include a high pressure water pump, for example, which may receive a relatively low pressure fluid input (such as a hose connected to a residential or commercial water supply), and may increase the pressure of the fluid to provide a relatively high pressure (e.g., relative to the relatively low pressure fluid input) fluid output. In such an example, the pump 12 may include a variety of configurations, such as a piston pump, a centrifugal pump, a swashplate pump, or the like. Further, while the present disclosure is generally described in terms of a pressure washer, e.g., for providing a relatively high pressure outlet flow of water, the system herein may be suitably used in other applications in which a pump may be driven by an engine coupled to the pump for providing pumping and/or a flow of any fluid. As such, in addition/as an alternative to being a high pressure pump, the pump may be any conveyance pump.

Continuing with the example embodiment, the pressure washer system 10 may also include an engine 14 drivingly coupled with the pump 12. That is the engine 14 may be coupled with the pump 12 via any suitable arrangement for driving the pump 12 (e.g., to cause the pump to increase the pressure of the fluid being pumped and/or to otherwise cause the pump to convey the fluid). Examples of suitable coupling arrangements may include, but are not limited to, shaft connection, belt drive, chain drive, gear drive, or the like. In various embodiments, the engine 14 may include any variety of internal combustion engine, such as a gasoline engine, a diesel engine, a propane or natural gas fired engine, as well as any other suitable engine. Further, in some embodiments, the engine 14 may include an electric motor, e.g., which may be powered by the battery 18 and/or by an external power supply (e.g., such as a domestic or commercial electrical mains).

It will be appreciated that the terms "high pressure" and "low pressure" are intended for the purpose of comparison only. Further, while the description may generally relate to high pressure and low pressure, the system herein may suitably be used in connection with systems that may provide relative high flow and low flow (e.g., with the flow increase resulting from the operation of the pump 12) regardless of the relative pressure of the flows. For the purpose of description, "low pressure" may generally indicate a portion of the pressure washer system upstream from the high pressure pump 12, and "high pressure" may generally denote a portion of the pressure washer system downstream from the high pressure pump 12.

The pressure washer controller 16 may include any suitable microcontroller, or off the shelf or specialized circuitry or hardware, that may monitor and/or control any aspect of the pump 12 and/or the engine 14. Accordingly, controller 16 may utilize one or more of software, firmware, and hardware programming to implement any of the control processes provided the by controller 16 and/or to monitor any aspects of the operation of the pump 12 and/or engine 14. Examples of control processes may include, but are not limited to, starting of the engine 14 (e.g., energizing a starter motor and/or energizing a starter engagement mechanism to engage the starter motor with a drive shaft of the engine), controlling an automatic choke associated with the engine, controlling a throttle associated with the engine, providing automated shut down of the engine, and the like. Monitoring aspects of the operation of the pump 12 and/or engine 14 may include but are not limited to, receiving one or more sensor inputs associated with various aspects of the pump and/or engine (as will be discussed in greater detail below), determining fault conditions associated with one or more of the pump and/or the engine, and the like.

According to an illustrative example embodiment, the battery 18 may be removably coupleable with the pressure washer controller 16. For example, the battery 18 may include a rechargeable battery that may be configured to be removably coupled with the pressure washer system 10. In such an implementation, the battery 18 may be physically and/or electrically coupled with the pressure washer system 10 for providing electrical power to the pressure washer system (e.g., for providing electrical power to one or more of the pressure washer controller 16, a starter associated with the engine 14, and/or to any other electrical systems associated with the pressure washer system). In some embodiments, the battery 18 may be generally physically configured similar to a conventional battery-operated power tool battery. According to such an embodiment, the battery 18 may include a lithium ion battery, and/or another rechargeable-type battery.

Consistent with the illustrative example embodiment, the battery 18 may include a memory module included for storing one or more of data received from the pressure washer controller 16 and data to be transmitted to the pressure washer controller 16. That is, the memory module may store data from the pressure washer controller 16 and/or intended for the pressure washer controller 16. The memory module may include any suitable memory module for storing data. Examples of the memory module may include but are not limited to non-volatile memory (e.g., flash memory), random access memory (RAM), writable computer storage media, and the like. In an embodiment, the memory module may be disposed within a housing of the battery 18. In such an embodiment, the memory module may be integrated with the battery. In a further embodiment, the memory module may include a removable and/or replaceable memory module, such as a flash drive, an SD card, a microSD card, and/or other removable memory module that may be removably coupled with the battery 18.

As generally discussed above, in an embodiment, the battery 18 may be communicatively coupleable with the pressure washer controller for one or more of receiving data from the pressure washer controller and transmitting data to the pressure washer controller. For example, in an embodiment the battery 18 may include a processor, microcontroller, and/or special purpose hardware for receiving data from the pressure washer controller 16 and/or for transmitting data to the pressure washer controller 16. For example, the processor, microcontroller, and/or special purpose hardware may coordinate reading and/or writing data from/to the memory module and communicating the data from/to the pressure washer controller 16. In an embodiment, the battery 18 may be communicatively coupleable with the pressure washer controller 16 via a wireless connection between the battery 18 and the pressure washer controller 16 (e.g., which may include corresponding communication functionality and hardware). Examples of suitable wireless connections may include, but are not limited to, infrared wireless connection, near field communication connection, Bluetooth connection, or the like.

Figure 2:
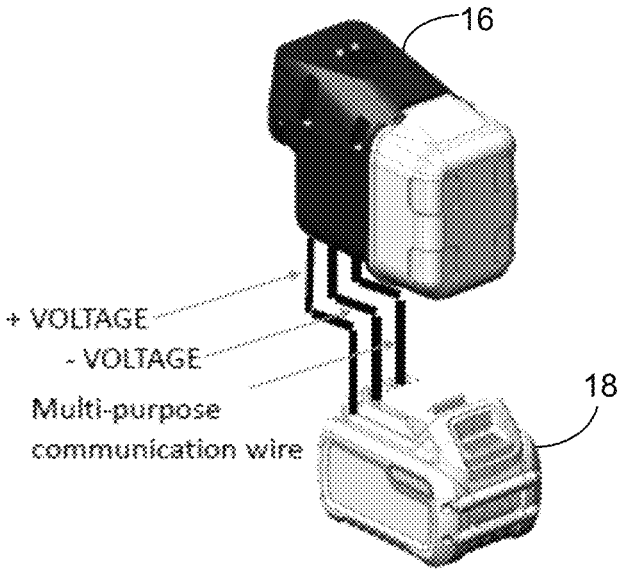
FIG. 2 schematically depicts a battery and pressure washer controller communication arrangement according to an illustrative embodiment.
Figure 3:
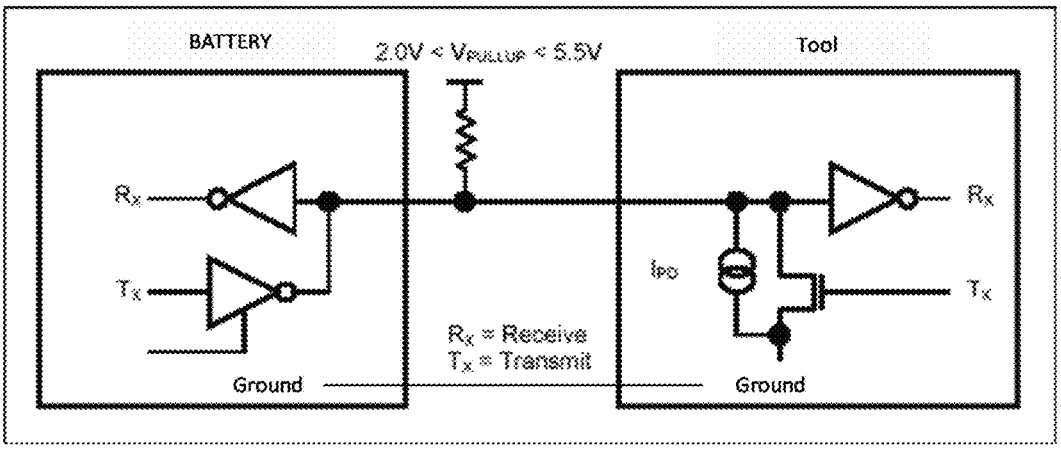
FIG. 3 schematically depicts a single wire communication interface according to an illustrative embodiment.

In some embodiments, the battery 18 may be communicatively coupleable with the pressure washer controller 16 (e.g., which may include corresponding communication functionality and hardware) via a wired connection between the battery 18 and the pressure washer controller 16. Examples of suitable wired connections may include a multi-data line wired connection (e.g., which may utilize two or more conductive pathways between the battery and the pressure washer controller for communication) and/or a single data line wired connection (e.g., which may modulate data across a single conductor between the battery and pressure washer controller for communication). For example, in a illustrative embodiment, the battery may include a commercially available battery may include a Max Tool Connect™ battery available under the DeWalt brand of Stanley Black and Decker, Inc. For example, and referring to FIGS. 2 and 3 an illustrative embodiment of a system utilizing a single wire interface and an illustrative single wire interface circuit are shown. Consistent with the illustrative embodiment, the single wire interface may allow data to be modulated on a single wire for communicating data between the battery 18 and the pressure washer controller 16. Such an embodiment may provide a relatively low cost, low speed baseband communication link between the battery 18 and the pressure washer controller 16.

In an illustrative embodiment, in addition being communicatively coupleable with the pressure washer controller 16, the battery 18 may include a communication module that may be configured to be communicatively coupled with one or more of a remote computing device and a data network. Accordingly, the battery 18 may communicate data received from the pressure washer controller 16 to the remote computing device and/or to the data network (e.g., and thereby to a computing device communicatively coupled with the data network). As indicated above, remote computing device is intended to include any computing device physically separate from the battery regardless of geographic proximity between the remote computing device and the battery. In some implementations, the communication module may be the same as and/or integrated with the communication interface capable of communicatively coupling the battery and the pressure washer controller, while in other implementations the communication module may be different and/or separate from the communication interface capable of communicatively coupling the battery and the pressure washer controller. In an illustrative embodiment the communication module may include and/or may be included in a system on chip that may include and/or interface with the memory module.

The communication module, in an illustrative embodiment, may include a wireless communication module, such as a Bluetooth radio, a WiFi radio, a near field communication radio, or the like. In another illustrative embodiment, the communication module may include a wired communication module, which may provide an Ethernet interface, a USB interface, other suitable wired data communication interface. Consistent with either implementation, the communication module of the battery 18 may allow data communication between the battery 18 and a remote computing device and/or a data network (e.g., and thereby to one or more computing devices in communication with the data network, such a s user computing device, a server, a special purpose computing device, or other computing device).

In an implementation, when the battery 18 is communicatively coupled with the pressure washer controller 16 (e.g., such as when the battery 18 is coupled with the pressure washer system 10 for providing electrical power to one or more components of the pressure washer system), data may be collected by the battery 18 from the pressure washer controller 16. For example, the pressure washer controller 16 may communicate performance data, usage data, sensor data, etc. to the battery 18 when the battery is communicatively coupled with the pressure washer controller. The battery 18 may store the data from the pressure washer controller 16 via the memory module. When the battery 18 is communicatively coupled with a remote computing device and/or a data network (e.g., via the communication module), the battery may communicate the data received from the pressure washer controller 16 (and/or may communication data based upon, at least in part, the data received from the pressure washer controller) to the remote computing device and/or the data network (e.g., to a computing device connected to the data network). In various embodiments, the battery 18 may be communicatively coupled to the remote computing device and/or the data network at the same time (and/or an overlapping time) during which the battery is communicatively coupled to the pressure washer controller 16), and/or the battery 18 may be communicatively coupled to the remote computing device and/or the data network at a later time (e.g., at which the battery may not be communicatively coupled with the pressure washer controller), after the data for the remote computing device and/or data network has been stored in the memory module.

In an implementation, when the battery 18 is communicatively coupled with the remote computing device and/or the data network, the battery may receive data (e.g., which may be stored on the memory module) that may be intended for the pressure washer controller (e.g., operating parameters or settings for the pressure washer system 10). Further, when the battery 18 is communicatively coupled with the pressure washer controller 16, the battery may transmit the stored data to the pressure washer controller. In various embodiments, the battery 18 may be communicatively coupled to the pressure washer controller 16 at the same time (and/or an overlapping time) during which the battery is communicatively coupled with the remote computing device and/or data network, and/or the battery may be communicatively coupled to the pressure washer controller 16 at some later time (e.g., at which the battery may not be communicatively coupled with the remote computing device and/or data network), after the data for the pressure washer system 10 has been stored in the memory module. Accordingly, communication between the battery 10 and the pressure washer controller 16 and between the battery and the remote computing device may occur simultaneously (including in real time), and/or at different times.

Figure 4:
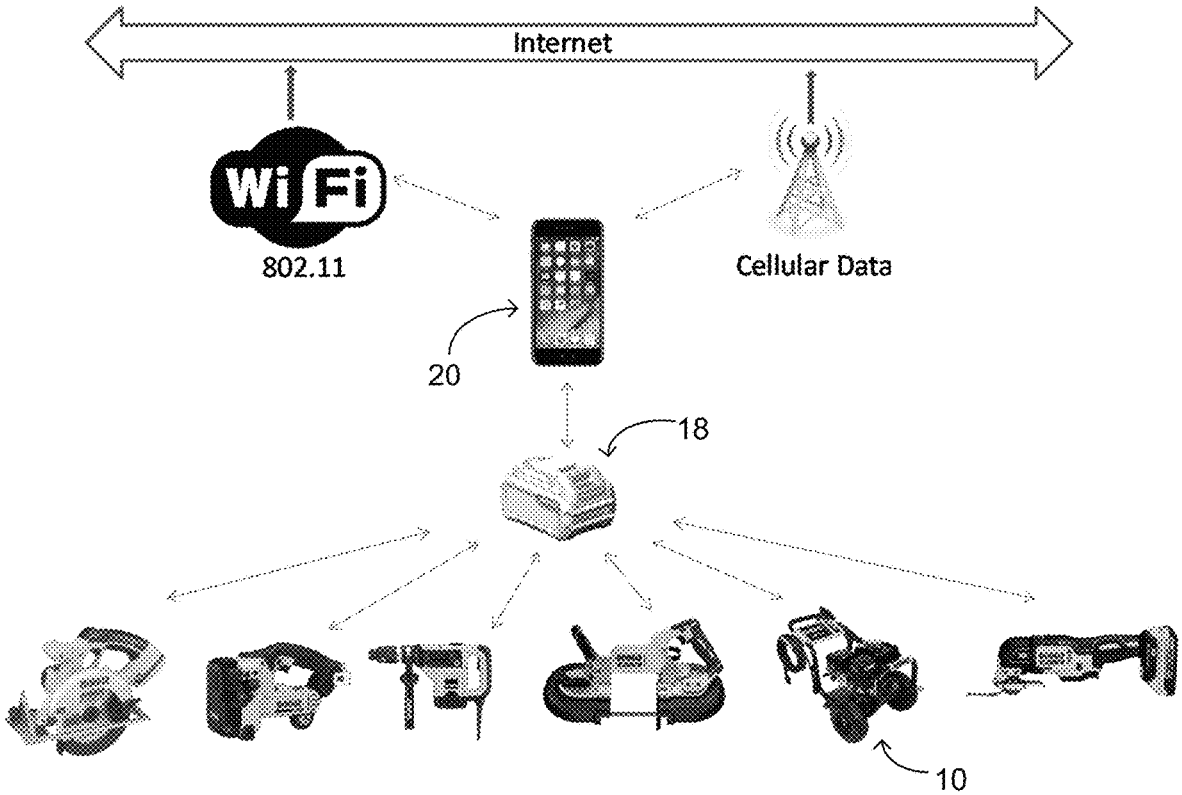
FIG. 4 diagrammatically depicts a communication topology according to an illustrative embodiment.

Referring also to FIG. 4, in an embodiment, the communication module of the battery 18 may include a wireless communication module (e.g., a Bluetooth radio, WiFi radio, near field communication radio, or the like) that may be configured to be communicatively coupled with a mobile computing device, such as a smartphone, tablet computing device, or the like (e.g., mobile device 20). Accordingly, and as generally discussed above, in an embodiment, the battery 18 may communicate with the mobile computing device 20 via the wireless communication module to receive data from the mobile computing device (e.g., such as operational settings and the like), which data may be communicated to the pressure washer controller 16 when the battery is communicatively coupled with the pressure washer controller (e.g., in a manner as discussed above). Further, in an embodiment, and as also generally discussed above, the battery 18 may communicate with the mobile computing device 20 via the wireless communication module to transmit data from the pressure washer controller 16 (e.g., such as performance data, usage data, and the like) to the mobile computing device. Communication between the battery 18 and the mobile communication device 20 may include communication with an application executed on the mobile computing device, as discussed in greater detail below.

With continued reference to FIG. 4, in an embodiment, the mobile computing device 20 may be capable of communicating with a data network (e.g., such as the Internet, a local area network, a wide area network, or the like). As used herein, the mobile device 20 communicating with a data network may include the mobile computing device communicating with one or more other computing devices via the data network. For example, as shown in the illustrative embodiment, the mobile computing device 20 may have wireless communication capabilities that may allow the mobile communication device to communicate with the data network via a WiFi connection and/or a cellular data connection. Accordingly, the mobile computing device 20 may receive data from, and/or transmit data to, another computing device via the data network. In this regard, the mobile computing device 20 may receive data from another computing device via the data network and may transmit data to the battery which may be based upon, at least in part, the data received from the other computer. Correspondingly, the mobile computing device 20 may transmit data to another computing device via the data network in which the data transmitted to the other computing device may be based upon, at least in part, the data received from the battery 18.

In some embodiments, the communication module of the battery may include a wireless communication module that may be configured to be communicatively coupled with a data network (e.g., either directly and/or via an access point or other intermediary device). For example, and as generally discussed above, the wireless communication module may include a Bluetooth module, a WiFi module, a cellular data module, or the like. In such an embodiment, the battery 18 may communicate with a computing device via the data network. In some embodiments, the battery may directly transmit data to, and/or receive data from, such a computing device via the data network, e.g., rather than transmitting data to, and/or receiving data from, a mobile computing device (e.g., that may receive and/or transmit data to a computing device via the data network).

As generally discussed above, the pressure washer controller 16 may be configured to receive one or more sensor inputs, e.g., from sensors associated with one or more of the pump, the engine, and/or another component of the pressure washer system 10. Examples of sensors associated with the pressure washer system 10 may include, but are not limited to, an engine temperature sensor (e.g., such as a thermistor or other sensor that may a measure surface temperature of the engine 14), a magneto voltage sensor (e.g., which may measure a voltage output of a magneto associated with the engine 14), a fuel level sensor (e.g., such as an accelerometer coupled with a fuel tank of the engine 14, which may measure changes in vibration of the fuel tank based upon, at least in part, how full the fuel tank is), an oil level sensor (e.g., such as a float switch that may detect a level of oil in the engine 14 and/or a level of oil in the pump 12, and/or may detect a low oil condition of the engine 14 and/or of the pump 12), a pump temperature sensor (e.g., such as a thermistor or other sensor that may measure a surface temperature of the pump 12), a flow switch (e.g. such as an optical sensor, reed sensor, or other flow sensor that may detect water flow through pressure washer water system, for example on one or both of the low pressure supply inlet and/or the high pressure outlet), and a counter or timer. It will be appreciated that various additional and/or alternative sensors may be associated with the pressure washer system 10 consistent with the present disclosure.

Based upon, at least in part, one or more of the sensor inputs, a variety of operating and/or usage characteristics regarding the pressure washer system 10 may be determined. For example, in addition to the temperature of the engine, the engine temperature sensor may allow the engine oil temperature to be determined and/or inferred (e.g., as being the same as or based upon the engine temperature). Similarly, the engine oil life may be determined based upon engine runtime (e.g., based upon, at least in part, the magneto voltage indicating operation of the engine and the timer or counter) and the engine oil temperature (e.g., based upon, at least in part, the engine temperature). The engine oil life may be based upon one or more predetermined runtime and temperature combinations. Similarly, a useful service life an air filter and spark plug of the engine can be determined based upon one or more of engine runtime and engine temperature. The air filter life and the spark plug life may be based upon, at least in part, respective predetermined runtimes and/or runtime and temperature combinations. Similarly, the need for engine maintenance may be determined, e.g., based upon, at least in part, engine runtime. In some implementations, the need for maintenance may further be based upon, at least in part, other factors, including, but not limited to, engine temperature history (e.g., engine temperature recorded over time), engine rpm history (e.g., engine rpm recorded over time, which may be based upon, at least in part, magneto voltage output), and the like. The need for engine maintenance may also be based upon, at least in part, one or more predetermined runtime, temperature, and rpm combinations. A fuel level may be determined based upon, at least in part, a detected accelerometer output through a mapping of the amount of vibration detected at the fuel tank for a give engine rpm (e.g., which may be based upon, at least in part, a detected magneto voltage).

In a similar manner as a variety of engine operating and/or usage characteristics may be determined based upon, at least in part, the various sensor inputs received by the pressure washer controller 16, a variety of pump operating and/or usage characteristics may also be determined based upon, at least in part, the various sensor inputs. For example, in addition to the surface temperature of the pump and the presence (and/or magnitude) of water flow through the pressure washer water system, a pump oil temperature may be determined based upon, at least in part, the surface temperature of the pump housing. A runtime of the pump may be determined based upon, at least in part, the magneto voltage (indicating that the engine is running and/or running above a preset rpm) and the counter or timer. The runtime of the pump in a high pressure operation mode (e.g., the pressure washer system is dispensing water at a high pressure) may be determined based upon flow, engine rpm, and the timer or counter. For example, if flow is detected by the flow sensor (e.g., indicating that water is flowing through the pressure washer pump) and the engine is operating in a midrange speed (e.g., engine rpm in a predetermined range based upon, at least in part, magneto voltage), it may be determined that pump is dispensing water and that the engine is under a relatively high load, indicative of a high pressure operating mode. Similarly, a runtime of the pump in a low pressure operation mode of the pressure washer (e.g., as may be experienced when dispensing a chemical agent, such as a detergent) may be determined based upon, at least in part, flow, engine rpm, and the counter or timer. For example, if flow is detected by the flow sensor (e.g., indicating that water is flowing through the pressure washer pump) and the engine is operating in high-range speed (e.g., engine rpm in a predetermined range based upon, at least in part, magneto voltage), it may be determined that the pump is dispensing water and that the engine is under a relatively low load, indicative of a low pressure operating mode. Further, a runtime of bypass mode of operation may be determined based upon, at least in part, flow, engine rpm, and the timer or counter. For example, if no flow of water is detected through the pressure washer system, but the engine is running (e.g., based upon, at least in part, the magneto voltage above a threshold indicating the engine is running) it may be determined that the pressure washer pump is operating in bypass mode.

It will be appreciated that while a variety of sensors have been discussed, and a variety of operating and/or usage characteristics have been described (along with methodologies for determining such operating and/or usage characteristics), such description is intended for illustrative purposes. Many different sensors and/or sensor types may be utilized in connection with a pressure washer system, and may different operating and/or usage characteristics may be determined and/or determined according to different methodologies. Further, as discussed above, the present disclosure may be utilized in connection with a wide variety of tool systems in addition and/or as an alternative to pressure washer systems. It will be appreciated that different tool systems may utilize different sensors and/or may have different operating and/or usage characteristics. Accordingly, such variation is considered to be encompassed by the present disclosure.

As generally discussed above, the battery 18 may be communicatively coupleable with the pressure washer controller 16 for receiving data based upon, at least in part, the one or more sensor inputs. In an embodiment, the data received by the battery 18 from the pressure washer controller may include the raw sensor data (e.g., engine surface temperature, pump surface temperature, magneto voltage, etc.). In an embodiment consistent with such an example, the battery 18 may transmit the raw sensor data to a remote computing device (e.g., such as a mobile computing device), and the remote computing device may, based upon, at least in part, the raw sensor data determine one or more operating and/or usage characteristics as discussed above. In such an embodiment, the pressure washer controller 16 may be relatively simple and low cost (e.g., as only being required to receive and store the raw sensor data and to transmit the raw sensor data to the battery). In another embodiment, the pressure washer controller 16 may include greater processing capabilities, and the pressure washer controller may determine one or more operating and/or usage characteristics based upon, at least in part, the received sensor data. In such an embodiment, the pressure washer controller 16 may transmit the determined operating and/or usage characteristics to the battery 18. In further embodiments, various combinations of the foregoing may be implemented (e.g., the pressure washer controller may transmit at least a portion of the raw sensor day and at least a portion of the determined operating and/or usage characteristics to the battery).

In addition and/or as an alternative to being communicatively coupleable with the pressure washer controller for receiving data relating to operation and/or usage (e.g., data based upon, at least in part, the sensor data), the battery 18 may be communicatively coupleable with the pressure washer controller 16 for transmitting one or more operational parameters for one or more of the pump and the engine to the pressure washer controller. For example, various operational parameters, or settings, associated with the operation and/or performance of the pressure washer system may be established, e.g., by a user of the mobile computing device (or other computing device via the data network) via a dedicated application or other interface. Such operational parameters may be communicated from the mobile computing device to the battery, and from the battery to the pressure washer controller. As such, a user and/or remote computing device may establish operational parameters that may control and/or alter the performance of the pressure washer system. As such, the one or more operational parameters may be received by the battery from a remote computing device. For example, the rpm ranges for the engine during high pressure and low pressure operations may be received by the pressure washer controller 16 from the battery 18 (e.g., which may have been received by the battery from a remote computing device and/or via the data network). Other examples of operational parameters may include automatic choke settings, throttle settings, and the like. Further, in an implementation in which the pressure washer system may automatically start the engine in response to a demand for high pressure output and/or automatically stop the engine when the demand for high pressure output ceases, the operational parameters may include a how long the engine continues to run before being stopped once the demand for high pressure output ceases. It will be appreciated that various additional and/or alternative operational parameters may be received by the pressure washer controller from the battery.

Consistent with the foregoing illustrative embodiments, data regarding the operation and usage of pressure washer may be received by a remote computing device, and/or operational parameters of the pressure washer may be established and communicated to the pressure washer. As generally discussed, in one implementation, the battery may provide communication between the pressure washer system (e.g., the pressure washer controller) and a remote computing device (such as a mobile computing device). In an illustrative embodiment, a mobile computing device, such as a smart phone, may execute an application that may communicate the battery of the pressure washer system for receiving and displaying operation and usage information regarding the pressure washer, and may allow a user to control various operational parameters vial the application (e.g., which may be transmitted to the battery and communicated to the pressure washer controller). For example, the smart phone application may allow a user to access information such as runtimes, maintenance needs (e.g., oil, air filter, and spark plug expected time to maintenance), operation states and alarms, such as oil level, oil temperature, pump temperature, pump pressure condition (e.g., low pressure operation, high pressure operation, etc.), and fuel level. Various additional and/or alternative information may be provided to a user of the pressure washer via the smart phone.

In some embodiments, certain information may be transmitted to, for example, a manufacturer of the pressure washer or a third party vendor, via a data network. Examples of such information may include information regarding the manner in which the pressure washer has been used (e.g., frequency of operation, runtime, operating conditions, etc.). Such information may be used by the manufacturer or third party for influencing future design revisions, determining possible misuse, to assist in customer service and/or remote trouble shooting, as well as various additional and/or alternative uses. Similarly, information may be utilized by the manufacturer or third party for marketing opportunities, such as sales of related equipment (such as maintenance needs for an upcoming maintenance cycle), sales of consumables (such as cleaning agents, service parts, etc.). It will be appreciated that information regarding the use, operation, and status of the pressure washer may collected and used for various additional and/or alternative uses.

The foregoing description has primarily pertained to an implementation of a pressure washer system. However, it will be appreciated that the present disclosure may be implemented in connection with a variety of battery powered tool systems. Examples of such tool systems may include, but is not limited to, battery powered saws, battery powered drills, battery powered nailers, battery powered outdoor equipment, and the like. Further, it will be appreciated that the number and types of sensors from which data may be received and/or derived may vary depending upon the type of tool system and the expected uses for the tool system. As such, the illustrative examples of sensors should not be construed as limiting, as any variety and number of sensors may be utilized. Similarly, the types of data that may be received and/or derived may similarly vary, and any description herein should be construed as illustrative and not limiting.

A variety of features of example implementations of a battery operated tool system have been described. However, it will be appreciated that various additional features and structures may be implemented in connection with a tool system according to the present disclosure. As such, the features and attributes described herein should be construed as a limitation on the present disclosure.

What is claimed is:

1. A pressure washer system comprising:

a pump;

an engine drivingly coupled with the pump;

a pressure washer controller associated with one or more of the pump and the engine; and a battery communicatively coupleable with the pressure washer controller for one or more of receiving data from the pressure washer controller and transmitting data to the pressure washer controller, wherein the battery is communicatively coupleable with the pressure washer controller via one or more of a wireless connection and a single wire interface between the battery and the pressure washer controller, the battery including a memory module for storing one or more of data received from the pressure washer controller and data to be transmitted to the pressure washer controller, and the battery including a communication module that is configured to be communicatively coupled with one or more of a remote computing device and a data network.

2. The pressure washer system according to claim 1, wherein the battery includes a rechargeable battery that is configured to be removably coupled with the pressure washer system.

3. The pressure washer system according to claim 1, wherein battery is configured for energizing an electric starter associated with the engine.

4. The pressure washer system according to claim 1, wherein the battery is communicatively coupleable with the pressure washer controller via a wired connection between the battery and the pressure washer controller.

5. The pressure washer system according to claim 1, wherein the communication module includes a wireless communication module that is configured to be communicatively coupled with a mobile computing device.

6. The pressure washer system according to claim 5, wherein the communication module includes a wireless communication module that is configured to be communicatively coupled with a data network.

7. The pressure washer system according to claim 1, wherein the communication module includes a wired communication module.

8. The pressure washer system according to claim 1, wherein the pressure washer controller is configured to receive one or more sensor inputs associated with one or more of the pump and the engine.

9. The pressure washer system according to claim 8, wherein the battery is communicatively coupleable with the pressure washer controller for receiving data based upon, at least in part, the one or more sensor inputs.

10. The pressure washer system according to claim 1, wherein the battery is communicatively coupleable with the pressure washer controller for transmitting one or more operational parameters for one or more of the pump and the engine to the pressure washer controller.

11. The pressure washer system according to claim 1, wherein the one or more operational parameters are received by the battery from a remote computing device.

* * * * *